US005102595A

United States Patent [19]

Tilby

[11] Patent Number: 5,102,595

[45] Date of Patent: Apr. 7, 1992

[54] APPARATUS AND METHOD FOR PILING STRANDS IN RANDOM ORIENTATION

[76] Inventor: Sydney E. Tilby, 4688 Boulderwood Dr., Victoria, B.C., Canada, V8Y 2P8

[21] Appl. No.: 637,342

[22] Filed: Jan. 4, 1991

[51] Int. Cl.[5] ..... D04H 1/70

[52] U.S. Cl. ..... 264/113; 264/518; 264/109; 264/121; 425/81.1; 425/83.1

[58] Field of Search ..... 264/518, 109, 113, 114, 264/121; 425/80.1, 81.1, 83.1

[56] References Cited

U.S. PATENT DOCUMENTS

| | | | |
|---|---|---|---|
| 2,592,470 | 4/1952 | Ryberg | 154/1 |
| 2,648,262 | 8/1953 | Croston et al. | 92/61 |
| 2,717,420 | 9/1955 | Roy | 18/22 |
| 2,744,045 | 5/1956 | Collins | 264/113 |
| 2,853,413 | 9/1958 | Christian | 154/132 |
| 2,979,105 | 4/1961 | Burkner | 425/81.1 |
| 3,164,511 | 1/1965 | Elmendorf | 161/57 |
| 3,464,877 | 9/1969 | Miller et al. | 156/259 |
| 3,464,881 | 9/1969 | Miller et al. | 161/60 |
| 3,567,511 | 3/1971 | Tilby | 127/43 |
| 3,665,065 | 5/1972 | Hass et al. | 264/113 |
| 3,690,358 | 9/1972 | Tilby | 146/119 |
| 4,025,278 | 5/1977 | Tilby | 425/404 |
| 4,102,963 | 7/1978 | Wood et al. | 264/518 |
| 4,212,616 | 7/1980 | Tilby | 425/256 |
| 4,312,677 | 1/1982 | Tilby et al. | 127/2 |
| 4,315,722 | 2/1982 | Ufermann | 425/83.1 |
| 4,494,919 | 1/1985 | Knudson et al. | 425/83.1 |
| 4,767,586 | 8/1988 | Radwanski et al. | 264/113 |
| 4,847,022 | 7/1989 | Bold | 264/40.7 |
| 4,971,540 | 11/1990 | Barnes | 425/81.1 |

*Primary Examiner*—Mary Lynn Theisen
*Attorney, Agent, or Firm*—Jansson & Shupe

[57] ABSTRACT

A method and apparatus for depositing straight elongate fiber-bundle strands, such as sugarcane or sweet sorghum rind strands, in a loose pile on a conveyor with the strands randomly oriented in substantially parallel planes during manufacture of structural panel from such strands. The method includes dropping bit by bit a randomly-oriented collection of strands over a drop edge located above the conveyor and flicking the strands onto the conveyor by quick downward motion of counter-rotating arrays of flicker tines in the drop zone.

18 Claims, 3 Drawing Sheets

FIG. 4
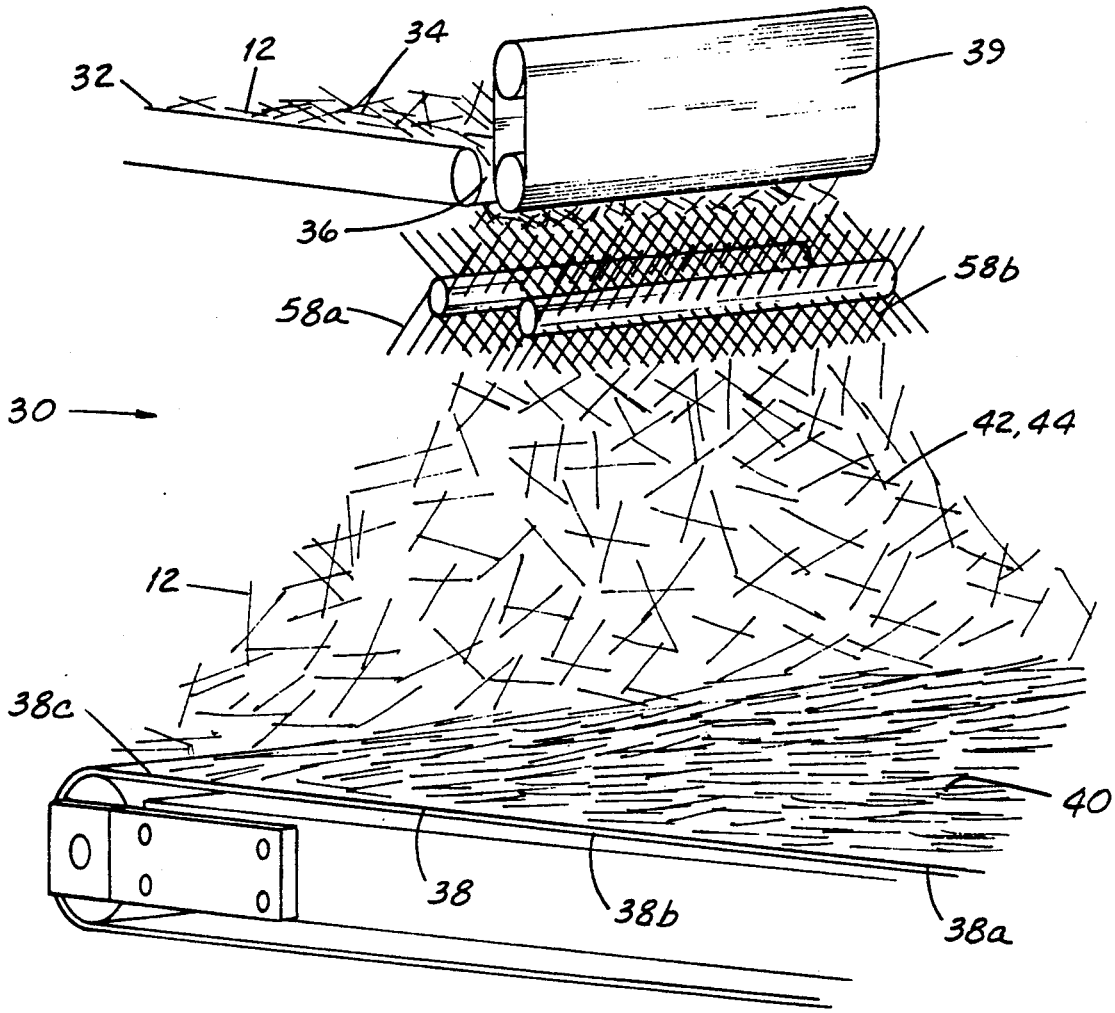
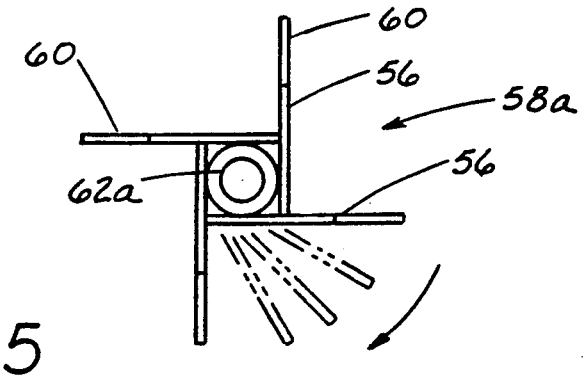
FIG. 5

APPARATUS AND METHOD FOR PILING STRANDS IN RANDOM ORIENTATIONFIELD OF THE INVENTION

This invention is related generally to the manufacture of building panels and, more particularly, to the manufacture of panels made of natural plant fibers like the woody rinds of grasses such as sugarcane and sweet sorghum.

BACKGROUND OF THE INVENTION

Many kinds of board products have been made from woody plant fibers in the form of chips, slabs, strands, shreds, particles, sawdust, shavings, comminutions, and other fiber forms. Such fibrous materials have been bound together using a variety of binders and forming methods to produce boards or panels referred to as chipboard, particle board, fiberboard, strand board, wood-wool board, veneer board, and pressboard, to name just some.

It is known that the woody rinds of grasses such as sugarcane and sweet sorghum can be used in producing some of such boards.

United States patents have been granted on various improvements relating to panels and boards, and/or their manufacture, including the following:

2,592,470 (Ryberg)
2,648,262 (Croston et al.)
2,717,420 (Roy)
2,853,413 (Christian)
3,164,511 (Elmendorf)
3,464,881 (Miller et al.)
3,464,877 (Miller et al.)
3,567,511 (Tilby)
3,690,358 (Tilby)
4,025,278 (Tilby)
4,212,616 (Tilby)
4,312,677 (Tilby et al.).

While some of these patents relate to the solid boards, many relate to lighter and less expensive boards and panels. A long-standing problem or shortcoming of the latter boards and panels is their structural weakness. Because of this, few of them have excellent weight-bearing and structural characteristics; such boards and panels often serve lesser covering, underlying, or decorative needs. Many of such boards and panels have little ability to serve in situations exposing them to weather, because weakening can occur.

In many cases, the strength of such panels and boards is provided primarily by the binder rather than by the fibers used in manufacture In some cases, a degree of strength is achieved by the degree of packing. In others, the use of large amounts of binder per unit volume of product increases the cost of such panels.

Such panels not only are lacking in structural strength, but typically do not have good insulating qualities. Because of this the usefulness of such panels is often quite limited.

Manufacture of such panels and boards has been carried out in various methods, some requiring complex extrusion equipment or other manufacturing equipment. The processes used in making such panels and boards often require extended periods to achieve drying throughout the cross-section of the board or panel, and significant amounts of energy.

A major problem in many developing countries and elsewhere is the shortage of high-quality building materials or, stated differently, the high cost of materials used for various building needs, including residential housing. In many cases, locally manufactured materials may not be available, requiring importation which adds to costs.

There is a clear need for an improved apparatus and method for manufacture of structural panels. Such apparatus must be low in cost and able to produce low-cost, light-weight structural panels with good load-bearing qualities, good insulative qualities, and good weather-resistance. An apparatus for production of such structural panels from sugarcane and sorghum rinds, particularly in developing countries, would provide important advantages.

A structural panel has been developed which meets the above-noted requirements and fills the above-noted needs. Such structural panel is made from the rinds of grasses selected from the group consisting of sugarcane and sweet sorghum, i.e., those grasses having woody rinds surrounding a pithy center, and has significantly improved structural characteristics. The apparatus and method of this invention are highly useful in high-speed manufacture of such panel.

Such structural panel is formed of a pile of rind fiber-bundle strands randomly oriented in substantially parallel planes. The strands are substantially straight and of sufficient length such that most have a stalk node thereon. Each strand has a multiplicity of contact points therealong with other strands of the pile, and a binder which coats the strands interconnects them at such contact points to form a substantially rigid structure. The coated interconnected strands define voids within the pile.

In such structural panel, strand length and substantial straightness are matters of considerable importance. The strands are made of rind fiber bundles, a term used to describe narrow strips of dried woody sugarcane or sorghum rind which, e.g., are split away from half-billet rinds in sugarcane or sweet sorghum processing using the so-called Tilby separation system. Very short, very thin, and/or very curly strands are not usable in such structural panel because they would not impart the desired structural strength.

That is, each strand is preferably at least 15 cm long, while a length of 20–30 cm is very highly preferred as offering the best panel qualities. Such fiber-bundle strands, which have a thickness equal to the thickness of the sugarcane or sorghum rind, are preferably at least about 0.10 cm wide, while widths of about 0.15–0.40 cm are very highly preferred. Dimensions of this general order will assure that the fiber-bundle strands are substantially straight as required.

Such structural panel is very light in weight, preferably having a density as low as about 0.15–0.25 g/cc. Yet such panel has superior structural qualities. In such structural panel the voids mentioned above are sufficient to allow air flow through the pile. This is so even though the panel is quite thick when compared to many other panels and boards.

The light weight and openness of such panel, and the fact that despite such qualities the panel has excellent structural strength, are related to the aforementioned random arrangement of the fiber-bundle strands in substantially parallel planes. Achieving an acceptable random arrangement in substantially parallel planes, and doing so in a high-speed manufacturing operation, are not easily accomplished.

The problems encountered include insufficient randomness, bunching, a need for strand redistribution after initial laying of a strand pile, and many others. Such problems may result in panel weakness, unacceptable variations in panel strength, and unsightly appearance. Even manual readjustment of an improperly laid pile can lead to such problems.

It is desirable for the aforementioned structural panel to have substantial width, given its intended uses in building construction or the like. Substantial panel width, and the resulting need for substantial width in a pile of fiber-bundle strands during manufacture of the paneling, tend to exacerbate the problems of achieving acceptable randomness in a random arrangement of fibers in generally parallel planes.

There is a need for a method and apparatus for creating, from a collection of strands, a considerable volume of strands arranged with suitable randomness in substantially parallel planes. A method and apparatus for piling such strands with acceptable randomness in a continuous high-speed operation would allow commercial manufacture of high-quality structural panel from the rinds of sugarcane, sweet sorghum and the like.

OBJECTS OF THE INVENTION

It is an object of this invention to provide an improved structural panel overcoming certain problems and shortcomings of boards and panels of the prior art.

Another object of this invention to provide an improved apparatus and method for production of structural panel overcoming some problems and shortcomings of the prior art.

Another object of this invention is to provide an improved structural panel having excellent load-bearing properties.

Another object of this invention is to provide an improved structural panel which is light in weight and inexpensive to produce.

Another object of this invention is to provide an apparatus and method for production of structural panel from grasses having woody rinds, such as sugarcane and sorghum.

Another object of this invention is to provide a method and apparatus for manufacture of structural panel which may be readily used in many developing countries to provide building materials from readily available resources.

Another object of this invention is to provide a method and apparatus for producing a random arrangement of strands in substantially parallel planes which has suitable randomness for high-quality structural panel.

Another object of this invention is to provide a method and apparatus for random strand arrangement successfully usable in a high-speed panel manufacturing operation.

Another object of this invention is to provide an improved apparatus and method for inexpensive production of structural panel.

These and other important objects will be apparent from the descriptions of this invention which follow.

SUMMARY OF THE INVENTION

This invention is an apparatus and method usable in the manufacture of a structural panel from a collection of randomly-arranged substantially straight elongate fiber-bundle strands which are from the rinds of grass selected from the group consisting of sugarcane and sweet sorghum. More specifically, the invention is an apparatus and method for depositing a collection of elongate, substantially stiff fiber-bundle strands on a surface in a loose pile with the strands randomly oriented in substantially parallel planes.

The apparatus can be described generally by reference to the method of this invention. The method includes: moving a randomly-arranged collection of such fibers bit by bit in a first direction toward a drop edge located above the surface on which the loose pile will be deposited; dropping strands of the collection over the drop edge bit by bit into a drop zone; and flicking the strands which are passing through the drop zone by quick downward motion of flicker tines rotating in downward arcs spaced above the surface. This action enlarges the drop zone and distributing the strands in the desired random orientation on the surface.

The flicking is preferably accomplished by a pair of counter-rotating tine sets which are adjacent to each other and each substantially peripherally aligned with the center of the drop zone. The quick downward motion of such tines is preferably at a speed far in excess of the downward velocity of strands above the flicker tines.

The flicker tines preferably have flexible tips. This tends to facilitate release of strands which are on the tines during their operation.

The surface on which the strands are deposited in this manner is preferably a moving conveyor. The drop zone has leading-edge, trailing-edge, and center portions, with conveyor movement being in a direction transverse to the drop edge so that the drop zone is enlarged in a direction along the conveyor. With this configuration, the trailing-edge and leading-edge portions of the drop zone are the first and last portions of the pile, respectively. This may allow the two surfaces of the resulting panel to have slightly different characteristics than the center portion, if the strands at the edge portions of a spread pattern are somewhat different from those in the middle of the pattern.

Each counter-rotating tine set is preferably attached to a rotating shaft, such pair of shafts being substantially parallel to the aforementioned drop edge and each about equidistant from such edge. Each tine is preferably attached to its shaft at a radially-offset peripheral position, with the tine extending tangentially from the shaft in a direction away from the direction of shaft rotation. This facilitates release of strands from the tines as they rotate.

In manufacture of the structural panel described above, the fiber-bundle strands are preferably coated with a binder before the moving, dropping, and flicking steps which deposit them in a pile on the conveyor surface. Such pile is then compressed to the final panel thickness and held there during a binder-curing operation. During and after compression the strands are maintained generally in the arrangement which such strands assumed during the strand depositing operation.

BRIEF DESCRIPTION OF THE DRAWINGS

FIG. 4 is reduced perspective view.

FIG. 5 is a fragmentary side elevation illustrating the action of one of the rotating tine sets.

DETAILED DESCRIPTIONS OF PREFERRED EMBODIMENTS

Figure 1:
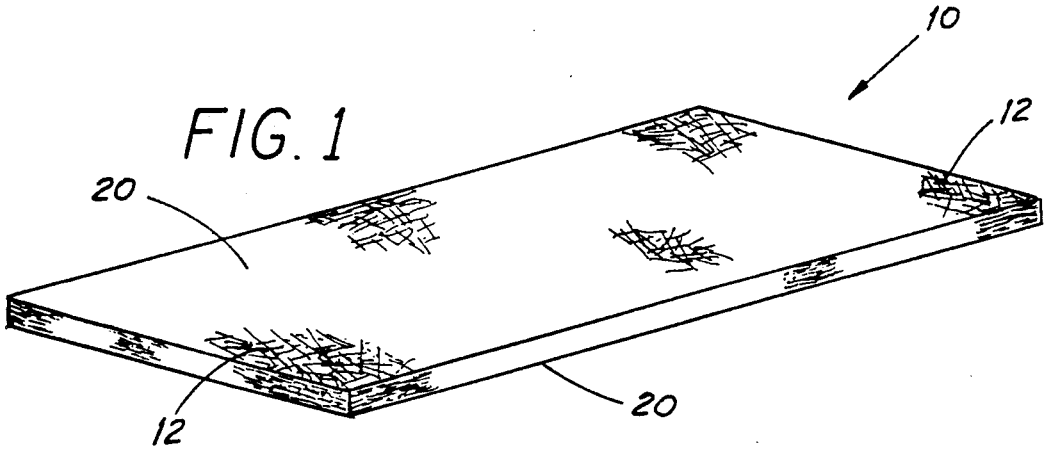
FIG. 1 is a perspective view of a structural panel made by an apparatus and method including the apparatus and method of this invention.
Figure 2:
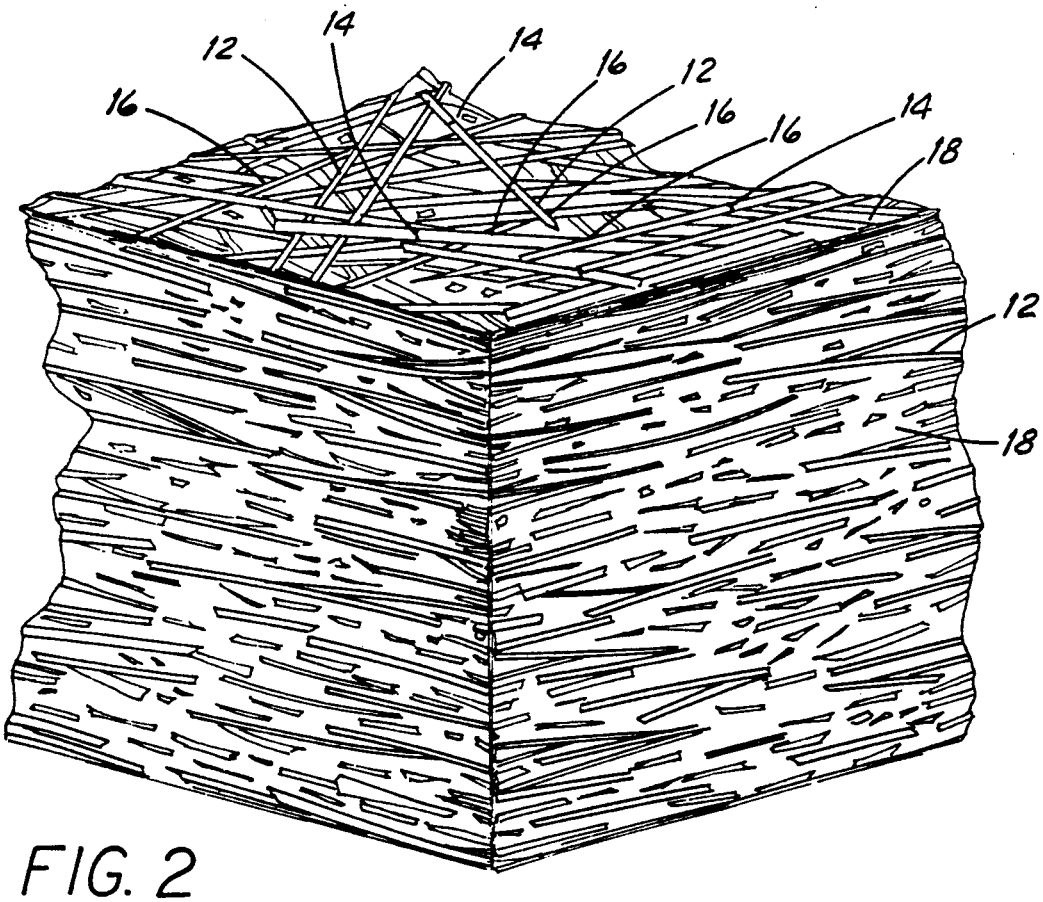
FIG. 2 is an enlarged (actual size) fragmentary perspective of the panel of FIG. 1.

FIGS. 1 and 2 show a structural panel 10 made using the apparatus and method of this invention, and other supporting apparatus not forming part of this invention. Panel 10 may be about 244 cm long, 122 cm wide, and about 7.6 cm thick (4 feet by 8 feet by 3 inches), or any other size useful in particular constructions. At such dimensions, panel 10 offers excellent structural and load-bearing qualities.

FIG. 2 serves to better illustrate some of the details of panel 10. Panel 10 is made from a pile of rind fiber-bundle strands 12 which are taken from the rinds of woody grass selected from the group consisting of sugarcane and sweet sorghum. Strands 12 of the pile are randomly oriented in substantially parallel planes, such arrangement being accomplished by the apparatus and method of this invention.

While reference throughout this application is made primarily to sugarcane, it is to be understood that such references are in no sense limiting. Fiber-bundle strands of any woody grass as described may be used.

Strands 12 are substantially straight and are long enough that most have a stalk node 14 somewhere along their lengths. Strands 12 are made from the woody rinds of billets of sugarcane or sweet sorghum stalk. Such billets, while cut without reference to the location of stalk nodes, are cut of sufficient length such that, given the range of natural spacings between such stalk nodes, most billets and hence most strands have a stalk node somewhere along their lengths.

To be even more specific, it is preferred than rind fiber-bundle strands 12 be at least about 15 cm long, and most preferably about 20–30 cm long.

The straightness of fiber-bundle strands 12 requires that they not be mere shreds or shavings, but instead substantially rigid pieces of woody rind. Preferred dimensions of strands 12 having such straightness include a thickness equal to the thickness of the rinds from which they are slit and a width of at least about 0.10 cm. Highly preferred widths are about 0.15–0.40 cm, such widths allowing maintenance of good strand straightness even for strands within the preferred range of 20–30 cm in length.

As already noted, strands 12 which constitute panel 10 are randomly oriented in substantially parallel planes using the apparatus and method of this invention. Each strand 12 has a large number of contact points 16 along its length, such contacting strands being interconnected at such points by a binder.

The binder of structural panel 10 is preferably a cured thermosetting formaldehyde-based condensation polymer which coats each strand 12 and interconnects it to other strands of the pile at the very great number of random contact points 16 throughout the pile. Examples of suitable condensation polymers are phenol-formaldehyde and melamine-formaldehyde. The most highly preferred polymers are water-resistant amino-formaldehyde polymers, such as melamine-formaldehyde. A particularly preferred polymer composition of the latter type has about 60% melamine and 40% formaldehyde.

Structural panel 10 preferably includes about 5–20% binder by weight of the panel. Thus, structural panel 10 obtains its strength not from the amount of binder used, but from strands 12 and the interconnection of such strands at contact points 16.

Given all these factors, structural panel 10 has significant voids 18 throughout its thickness 10, as can easily be seen in FIGS. 1 and 2. This openness is sufficient to allow air to be blown through the pile, a processing advantage. And, when both of the sides 20 of panel 10 have covering layers thereon, as hereafter described, a dead space is created therebetween which provides excellent insulating qualities.

Voids 18 also allow structural panel 10 to be light in weight. Panel 10 panel preferably has an average density of only about 0.15–0.25 g/cc.

Figure 3:
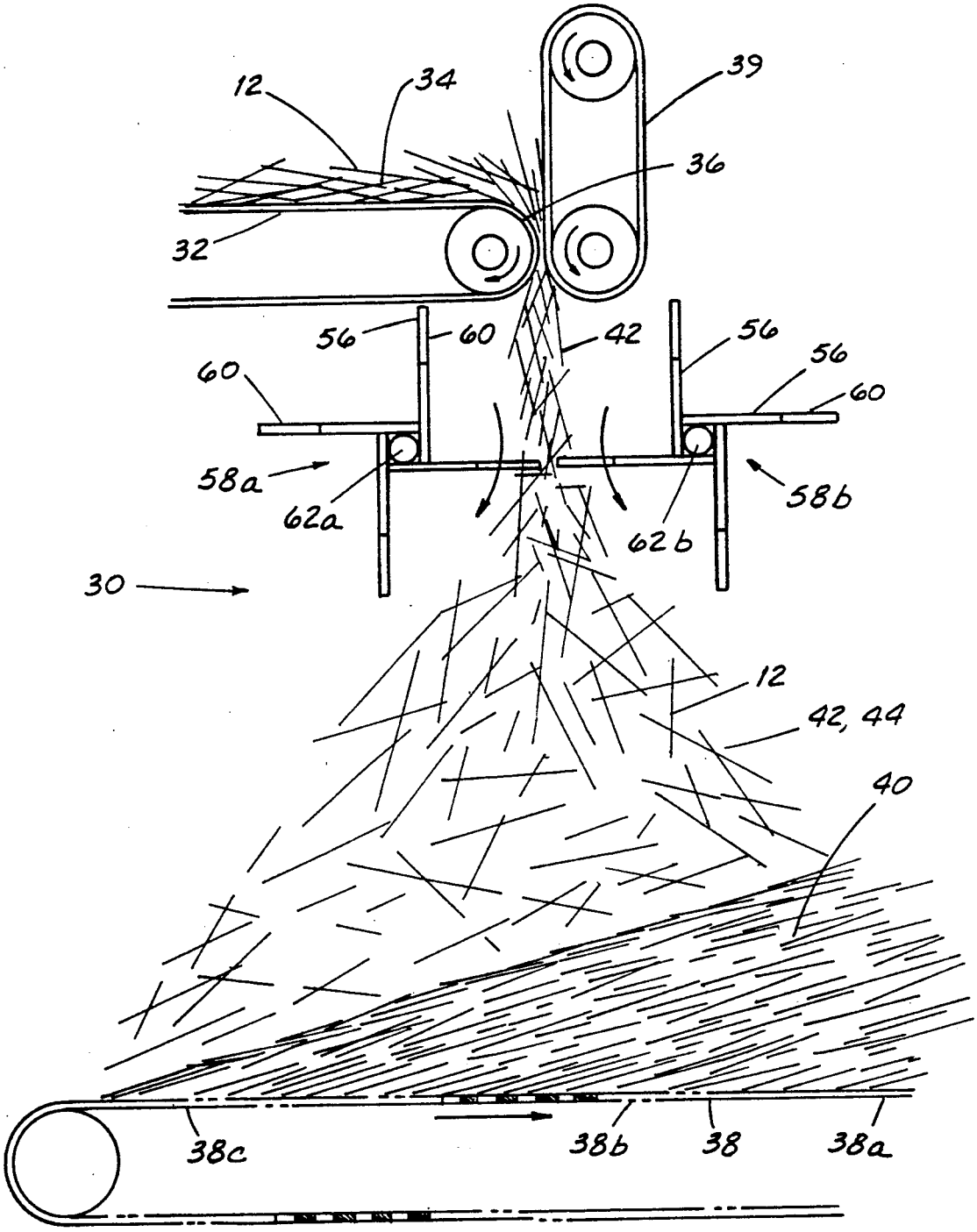
FIG. 3 is a side elevation, partially in section, of the strand-depositing apparatus of this invention.

Turning now to information more directly related to the method and apparatus of this invention, FIGS. 3–5 illustrate a strand-depositing apparatus 30 in accordance with this invention. Strand-depositing apparatus 30 includes an upper conveyor 32 which carries a randomly-arranged collection 34 of substantially straight elongate fiber-bundle strands 12 of the type already described. Strands 12 are already coated by a thin coat of binder, such binder having just been applied.

Upper conveyor 32 moves collection 34 toward and over a drop edge 36 located directly above a continuously moving lower conveyor 38, which is a perforated belt. Coacting with upper conveyor 32 is a drop conveyor 39 which assures that coated strands 12 of collection 34 drop immediately at drop edge 36, into a drop zone 42.

Lower conveyor 38 extends in the same direction as that of upper conveyor 32. Lower conveyor 38 continues to a position well beyond that illustrated in the drawings, for subsequent processing of a pile 40 of strands 12 which has been deposited on lower conveyor 38 in a random orientation with fibers 12 in substantially parallel planes.

The deposit of coated strands 12 onto lower conveyor 38 involves what might be described as a sort of throwing of strands 12. Upper conveyor 32 and drop conveyor 39 cooperate to drop strands 12 into drop zone 42 which extends into and between an array of flicker tines 56.

Flicker tines 56 flick the strands downwardly in a spread pattern 44 to fall on lower conveyor 38 or, in most cases, on pile 40 of other strands 12 which accumulates on moving lower conveyor 38. Flicker tines 56 rotate in downward arcs spaced above lower conveyor 38. This flicker action enlarges drop zone 42 into spread pattern 44 at positions below the array of flicker tines 56, and distributes strands 12 in the desired random orientation on lower conveyor 38.

A pair of counter-rotating tine sets 58*a* and 58*b* are adjacent to each other and each substantially peripherally aligned with the center of drop zone 42. The quick downward motion of tines 56 is at a speed far in excess of the downward velocity of strands 12 above tine arrays 58*a* and 58*b*.

Flicker tines 56 have flexible tips 60, which tend to facilitate release of coated strands 12 which are on tines 56 during their operation.

Counter-rotating tine sets 58*a* and 58*b* are attached to rotating shafts 62*a* and 62*b*, respectively. Shafts 62*a* and 62*b* are each parallel to drop edge 36, and equidistant from such edge. Each flicker tine 56 is attached to its shaft 62*a* or 62*b* at a radially-offset peripheral position, with tine 56 extending tangentially from such shaft in a direction away from the direction of shaft rotation, as shown in FIG. 5. This facilitates release of strands 12 from tines 56 as the tine arrays rotate.

Since lower conveyor 38 is moving as strands 12 are dropped on it, the portion of lower conveyor 38 shown in FIGS. 3 and 4 is a drop zone which has a leading-edge portion 38*a*, a center portion 38*b*, and a trailing-edge portion 38*c*. Trailing-edge portion 38*c* and leading-edge portion 38*a* are the first and last portions of pile 40.

If the characteristics of strands at the edges of spread pattern 44 are at all different from those in the middle, this will give the two surfaces of the structural panel slightly different characteristics than the center portion. For example, smaller strands at the surfaces give a slightly more closed appearance on the panel surfaces than would otherwise be the case.

Strand pile 40 on lower conveyor 38 is substantially compressible and relatively loose. Its strands are oriented, on average, in planes which are substantially parallel to each other and at a slight tilt with respect to the plane of conveyor 38. Such tilt occurs because pile 40 is continuously moving away from the position at which strands 12 are deposited on it. When pile 40 is compressed, as occurs at a downstream position not shown, the angle of such tilt is substantially lessened, such that the strands, on average, are in parallel planes which are much closer to parallel to the plane of lower conveyor 38.

While the principles of this invention have been described in connection with specific embodiments, it should be understood clearly that these descriptions are made only by way of example and are not intended to limit the scope of the invention.

I claim:

1. In a method for manufacture of a structural panel from a collection of randomly-arranged substantially straight elongate fiber-bundle strands, such strands of the rinds of grass selected from the group consisting of sugarcane and sweet sorghum, including depositing the strands on a surface in a loose pile with the strands randomly oriented in substantially parallel planes, the improvement comprising:

dropping strands of the collection bit by bit into a drop zone above the surface; and flicking the strands passing through the drop zone by quick downward motion of flicker tines rotating in downward arcs spaced above the surface, such flicking being by a pair of counter-rotating tine sets adjacent to each other, each substantially peripherally aligned with the center of the drop zone and equidistant above said surface, the rotation of the tine sets being in a downward direction at the position therebetween;

thereby enlarging the drop zone and distributing the strands in said random orientation on the surface.

2. The method of claim 1 wherein the quick downward motion is at a speed far in excess of the downward velocity of strands above the flicker tines.

3. The method of claim 1 wherein the flicker tines have flexible tips, thereby to facilitate release of strands thereon.

4. The method of claim 1 wherein the surface is a moving conveyor.

5. The method of claim 4 wherein:

the drop zone has leading-edge, trailing-edge, and center portions; and conveyor movement is in a direction transverse to the rotational axes of the tine sets so that the drop zone is enlarged in a direction along the conveyor, whereby the leading-edge and trailing-edge portions of the drop zone are the first and last portions of the pile.

6. The method of claim 5 wherein strand content of the leading-edge and trailing-edge portions of the drop zone differs from strand content of the center portion, thereby giving the structural panel surface content differing somewhat from its center content.

7. The method of claim 4 wherein each counter-rotating tine set is attached to a rotating shaft, such shafts being substantially parallel to each other and substantially equidistant from the drop zone.

8. The method of claim 7 wherein each tine is attached to its shaft at a radially-offset peripheral position, such tine extending tangentially from the shaft in a direction away from the direction of rotation, whereby release of strands from the tine is facilitated.

9. The method of claim 1 wherein the strands are coated with a binder before the moving, dropping, and flicking steps.

10. Apparatus for depositing a collection of elongate, substantially straight, substantially stiff fiber-bundle strands on a surface in a loose pile with the strands randomly oriented in substantially parallel planes, comprising:

means for dropping strands of the collection bit by bit into a drop zone above the surface; and a pair of counter-rotating tine sets adjacent to each other and each substantially peripherally aligned with the center of the drop zone and equidistant above said surface, the rotation of the tine sets being in a downward direction at the position therebetween for downwardly flicking the strands passing through the drop zone to enlarge the drop zone and distribute the strands in said random orientation on the surface.

11. The apparatus of claim 10 including means to rotate each tine set at a speed such that downward tine motion is at a speed far in excess of the downward velocity of strands above the flicker tines.

12. The apparatus of claim 10 wherein the flicker tines have flexible tips, thereby to facilitate release of strands thereon.

13. The apparatus of claim 10 wherein the surface is a moving conveyor.

14. The apparatus of claim 13 wherein:

the drop zone has leading-edge, trailing-edge, and center portions; and conveyor movement is in a direction transverse to the rotational axes of the tine sets so that the drop zone is enlarged in a direction along the conveyor, whereby the leading-edge and trailing-edge portions of the drop zone are the first and last portions of the pile.

15. The apparatus of claim 14 wherein strand content of the leading-edge and trailing-edge portions of the drop zone differs from strand content of the center portion, thereby giving the structural panel surface content differing somewhat from its center content.

16. The apparatus of claim 13 wherein each counter-rotating tine set is attached to a rotating shaft, such shafts being substantially parallel to each other and substantially equidistant from the drop zone.

17. The apparatus of claim 16 wherein each tine is attached to its shaft at a radially-offset peripheral position, such tine extending tangentially from the shaft in a direction away from the direction of rotation, whereby release of strands from the tine is facilitated.

18. The apparatus of claim 10 wherein the flicker tines have flexible tips, thereby to facilitate release of strands thereon.

* * * * *